US011761339B2

(12) United States Patent
Prabhu et al.

(10) Patent No.: US 11,761,339 B2
(45) Date of Patent: Sep. 19, 2023

(54) TURBINE BLADE

(71) Applicant: Siemens Energy Global GmbH & Co. KG, Munich (DE)

(72) Inventors: Bharat Prabhu, Port Orange, FL (US); Farzad Taremi, Palm Beach Gardens, FL (US); Ross Gustafson, Charlotte, NC (US); Andrew Miller, Ft. Worth, TX (US); Masayoshi Senga, California, MD (US); Anne Maria Starke, Berlin (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 0 days.

(21) Appl. No.: 17/998,812

(22) PCT Filed: May 20, 2020

(86) PCT No.: PCT/US2020/033701

§ 371 (c)(1),
(2) Date: Nov. 15, 2022

(87) PCT Pub. No.: WO2021/236073

PCT Pub. Date: Nov. 25, 2021

(65) Prior Publication Data

US 2023/0139869 A1 May 4, 2023

(51) Int. Cl.

| | |
|---|---|
| ***F01D 5/18*** | (2006.01) |
| ***F01D 5/14*** | (2006.01) |
| ***F01D 5/20*** | (2006.01) |

(52) U.S. Cl.

CPC ..... *F01D 5/18* (2013.01); *F01D 5/141* (2013.01); *F05D 2260/20* (2013.01)

(58) Field of Classification Search

CPC . F01D 5/20; F01D 5/186; F01D 5/187; F01D 5/18; F01D 25/12; F01D 5/145;

(Continued)

(56) References Cited

U.S. PATENT DOCUMENTS 6,059,530 A * 5/2000 Lee ..... F01D 5/20 416/96 A
7,632,062 B2 * 12/2009 Harvey ..... F01D 5/20 415/173.1

(Continued)

FOREIGN PATENT DOCUMENTS

| | | |
|---|---|---|
| EP | 1253292 A2 | 10/2002 |
| WO | 2017119898 A1 | 8/2018 |
| WO | 2019088992 A1 | 5/2019 |

OTHER PUBLICATIONS

PCT International Search Report and Written Opinion of International Searching Authority dated Aug. 13, 2020 corresponding to PCT International Application No. PCT/US2020/033701 filed May 20, 2020.

*Primary Examiner* — Eric J Zamora Alvarez

(57) ABSTRACT

A turbine blade includes a root arranged to attach the turbine blade to a rotor and a vane extending in a radial direction from the root to a tip surface. The vane includes a leading edge, a trailing edge, a pressure-side surface, and a suction-side surface that cooperate to define a vane perimeter. A perimeter wall extends radially from the tip surface and surrounds a portion of the vane perimeter. A first trench wall extends across the tip surface and cooperates with the perimeter wall to substantially enclose a pressure-side pocket and a second trench wall extends across the tip surface and cooperates with the perimeter wall to substantially enclose a suction-side pocket.

21 Claims, 7 Drawing Sheets

(58) Field of Classification Search
CPC ..... F01D 5/147; F01D 9/065; F01D 11/08; F01D 11/18; F01D 5/143; F01D 5/188; F01D 9/041; F01D 5/141; F01D 5/225; F05D 2260/202; F05D 2220/32; F05D 2240/307; F05D 2260/204; F05D 2250/141; F05D 2250/185; F05D 2260/20; F05D 2260/205; F05D 2240/125; F05D 2240/122; F05D 2240/126; F05D 2240/127; F05D 2240/81; F05D 2240/11; F05D 2240/121; F05D 2260/22141; F05B 2240/801
See application file for complete search history.

(56) References Cited

U.S. PATENT DOCUMENTS

| | | | | |
|---|---|---|---|---|
| 8,133,032 | B2 * | 3/2012 | Tibbott ..... | F01D 5/20 416/235 |
| 2005/0232771 | A1 | 10/2005 | Harvey et al. | |
| 2013/0294898 | A1 | 11/2013 | Lee | |
| 2018/0216471 | A1 | 8/2018 | Rathay et al. | |
| 2019/0257205 | A1 | 8/2019 | Webster et al. | |

* cited by examiner

TURBINE BLADE

BACKGROUND

Turbines, including steam turbines and gas turbines operate in a high-temperature environment. High temperature fluid flows between adjacent blades and is expanded to produce mechanical work that is used to drive a device such as an electrical generator. During operation of the turbine, some of the fluid leaks across a tip of the blades which results in a loss in efficiency. While many tip seal arrangements exist, the high temperature operating environment, particularly in gas turbines causes differential thermal growth between the various components that make up the seal arrangement making efficient sealing difficult.

BRIEF SUMMARY

A turbine blade includes a root arranged to attach the turbine blade to a rotor and a vane extending in a radial direction from the root to a tip surface. The vane includes a leading edge, a trailing edge, a pressure-side surface, and a suction-side surface that cooperate to define a vane perimeter. A perimeter wall extends radially from the tip surface and surrounds a portion of the vane perimeter. A first trench wall extends across the tip surface and cooperates with the perimeter wall to substantially enclose a pressure-side pocket and a second trench wall extends across the tip surface and cooperates with the perimeter wall to substantially enclose a suction-side pocket.

In another arrangement, a turbine blade includes a root arranged to attach the turbine blade to a rotor, a platform coupled to the root, and a vane extending in a radial direction from the platform to a tip surface. The vane includes a leading edge, a trailing edge, a pressure-side surface, and a suction-side surface that cooperate to define a vane perimeter. A perimeter wall extends radially from the tip surface and surrounds a portion of the vane perimeter. A trench extends from a first portion of the suction-side surface near the leading edge to a second portion of the suction-side surface near the trailing edge, the trench including a first trench wall, a second trench wall, and a trench bottom. A pressure-side pocket is defined by the first trench wall and a portion of the perimeter wall and a suction-side pocket is defined by the second trench wall and a portion of the perimeter wall.

In yet another arrangement, a turbine blade includes a root arranged to attach the turbine blade to a rotor, a platform coupled to the root, and a vane extending in a radial direction from the platform to a tip surface, the vane including a leading edge, a trailing edge, a pressure-side surface, and a suction-side surface that cooperate to define a vane perimeter. A curved trench extends from a first portion of the suction-side surface near the leading edge to a second portion of the suction-side surface near the trailing edge, the trench including a trench bottom that is radially nearer the platform than the tip surface. A pressure-side pocket is defined by a pressure-side wall, a leading-edge wall, a first suction-side wall, a first trench wall, and a second suction-side wall that each extend radially away from the tip surface and a suction-side pocket is defined by a third suction-side wall and a second trench wall that each extend radially away from the tip surface.

DESCRIPTION OF THE DRAWINGS

To easily identify the discussion of any particular element or act, the most significant digit or digits in a reference number refer to the figure number in which that element is first introduced.

DETAILED DESCRIPTION

Figure 1:
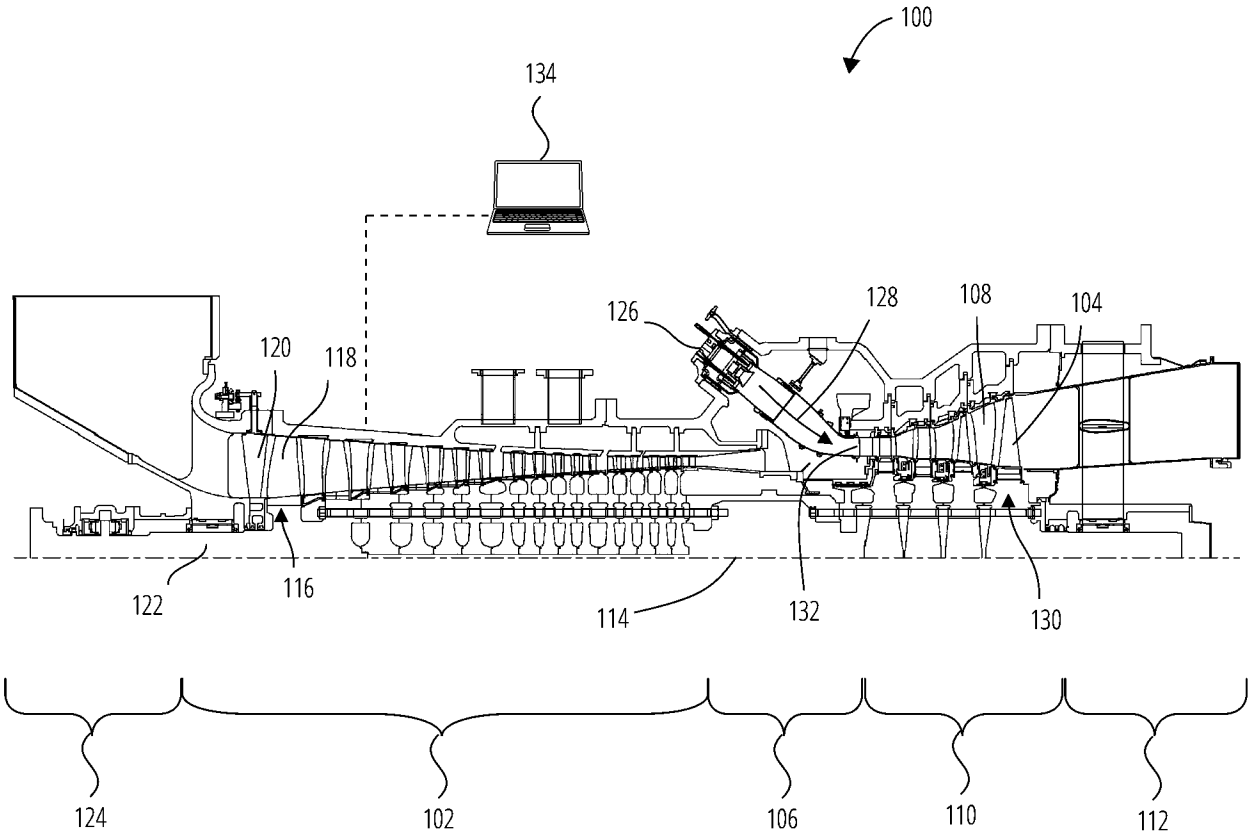
FIG. 1 is a longitudinal cross-sectional view of a gas turbine engine 100 taken along a plane that contains a longitudinal axis or central axis.

Before any embodiments of the invention are explained in detail, it is to be understood that the invention is not limited in its application to the details of construction and the arrangement of components set forth in this description or illustrated in the following drawings. The invention is capable of other embodiments and of being practiced or of being carried out in various ways. Also, it is to be understood that the phraseology and terminology used herein is for the purpose of description and should not be regarded as limiting.

Various technologies that pertain to systems and methods will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to exemplary non-limiting embodiments.

Also, it should be understood that the words or phrases used herein should be construed broadly, unless expressly limited in some examples. For example, the terms "including," "having," and "comprising," as well as derivatives thereof, mean inclusion without limitation. The singular forms "a", "an" and "the" are intended to include the plural forms as well, unless the context clearly indicates otherwise. Further, the term "and/or" as used herein refers to and encompasses any and all possible combinations of one or more of the associated listed items. The term "or" is inclusive, meaning and/or, unless the context clearly indicates otherwise. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Furthermore, while multiple embodiments or constructions may be described herein, any features, methods, steps, components, etc. described with regard to one embodiment are equally applicable to other embodiments absent a specific statement to the contrary.

Also, although the terms "first", "second", "third" and so forth may be used herein to refer to various elements, information, functions, or acts, these elements, information, functions, or acts should not be limited by these terms. Rather these numeral adjectives are used to distinguish different elements, information, functions or acts from each other. For example, a first element, information, function, or act could be termed a second element, information, function, or act, and, similarly, a second element, information, function, or act could be termed a first element, information, function, or act, without departing from the scope of the present disclosure.

In addition, the term "adjacent to" may mean: that an element is relatively near to but not in contact with a further element; or that the element is in contact with the further portion, unless the context clearly indicates otherwise. Further, the phrase "based on" is intended to mean "based, at least in part, on" unless explicitly stated otherwise. Terms "about" or "substantially" or like terms are intended to cover variations in a value that are within normal industry manufacturing tolerances for that dimension. If no industry standard is available, a variation of twenty percent would fall within the meaning of these terms unless otherwise stated.

FIG. 1 illustrates an example of a gas turbine engine 100 including a compressor section 102, a combustion section 106, and a turbine section 110 arranged along a central axis 114. The compressor section 102 includes a plurality of compressor stages 116 with each compressor stage 116 including a set of rotating blades 118 and a set of stationary vanes 120 or adjustable guide vanes. A rotor 122 supports the rotating blades 118 for rotation about the central axis 114 during operation. In some constructions, a single one-piece rotor 122 extends the length of the gas turbine engine 100 and is supported for rotation by a bearing at either end. In other constructions, the rotor 122 is assembled from several separate spools that are attached to one another or may include multiple disk sections that are attached via a bolt or plurality of bolts.

The compressor section 102 is in fluid communication with an inlet section 124 to allow the gas turbine engine 100 to draw atmospheric air into the compressor section 102. During operation of the gas turbine engine 100, the compressor section 102 draws in atmospheric air and compresses that air for delivery to the combustion section 106. The illustrated compressor section 102 is an example of one compressor section 102 with other arrangements and designs being possible.

In the illustrated construction, the combustion section 106 includes a plurality of separate combustors 126 that each operate to mix a flow of fuel with the compressed air from the compressor section 102 and to combust that air-fuel mixture to produce a flow of high temperature, high pressure combustion gases or exhaust gas 128. Of course, many other arrangements of the combustion section 106 are possible.

The turbine section 110 includes a plurality of turbine stages 130 with each turbine stage 130 including a number of rotating turbine blades 104 and a number of stationary turbine vanes 108. The turbine stages 130 are arranged to receive the exhaust gas 128 from the combustion section 106 at a turbine inlet 132 and expand that gas to convert thermal and pressure energy into rotating or mechanical work. The turbine section 110 is connected to the compressor section 102 to drive the compressor section 102. For gas turbine engines 100 used for power generation or as prime movers, the turbine section 110 is also connected to a generator, pump, or other device to be driven. As with the compressor section 102, other designs and arrangements of the turbine section 110 are possible.

An exhaust portion 112 is positioned downstream of the turbine section 110 and is arranged to receive the expanded flow of exhaust gas 128 from the final turbine stage 130 in the turbine section 110. The exhaust portion 112 is arranged to efficiently direct the exhaust gas 128 away from the turbine section 110 to assure efficient operation of the turbine section 110. Many variations and design differences are possible in the exhaust portion 112. As such, the illustrated exhaust portion 112 is but one example of those variations.

A control system 134 is coupled to the gas turbine engine 100 and operates to monitor various operating parameters and to control various operations of the gas turbine engine 100. In preferred constructions the control system 134 is typically micro-processor based and includes memory devices and data storage devices for collecting, analyzing, and storing data. In addition, the control system 134 provides output data to various devices including monitors, printers, indicators, and the like that allow users to interface with the control system 134 to provide inputs or adjustments. In the example of a power generation system, a user may input a power output set point and the control system 134 may adjust the various control inputs to achieve that power output in an efficient manner.

The control system 134 can control various operating parameters including, but not limited to variable inlet guide vane positions, fuel flow rates and pressures, engine speed, valve positions, generator load, and generator excitation. Of course, other applications may have fewer or more controllable devices. The control system 134 also monitors various parameters to assure that the gas turbine engine 100 is operating properly. Some parameters that are monitored may include inlet air temperature, compressor outlet temperature and pressure, combustor outlet temperature, fuel flow rate, generator power output, bearing temperature, and the like. Many of these measurements are displayed for the user and are logged for later review should such a review be necessary.

Figure 2:
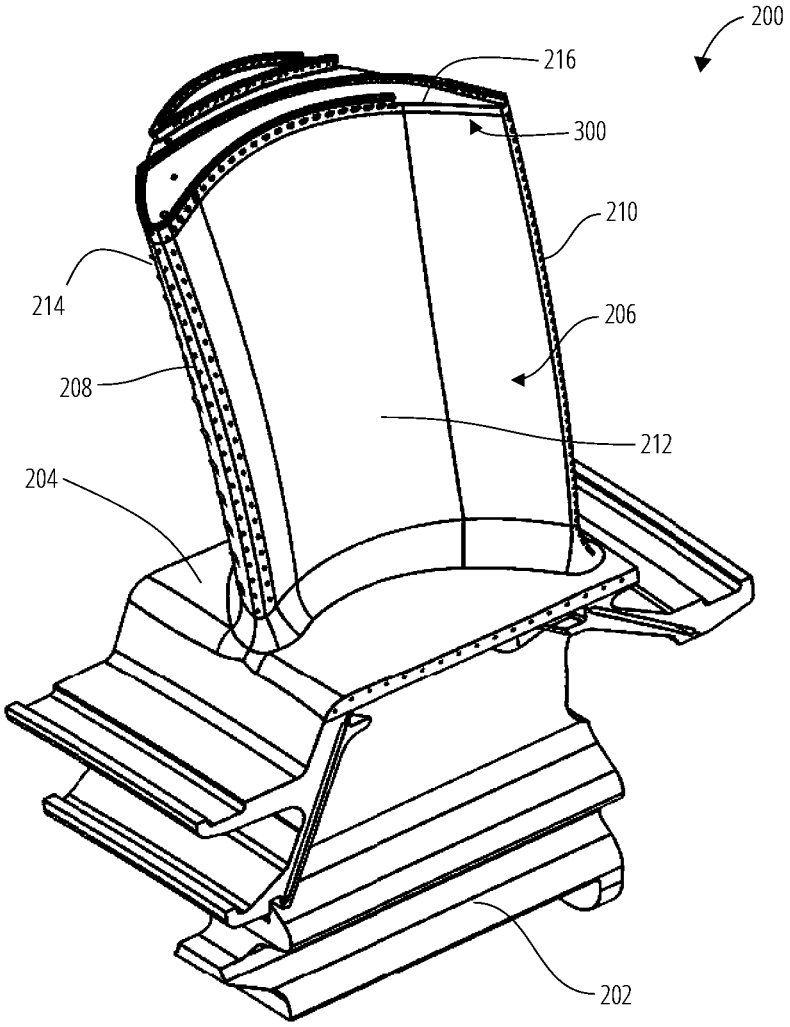
FIG. 2 illustrates a turbine blade suitable for use with the gas turbine engine of FIG. 1.

FIG. 2 illustrates a turbine blade 200 of the type used as a rotating blade 118 in one of the turbine stages 130. The turbine blade 200 includes a root 202, a platform 204, and an airfoil 206 (sometimes referred to as a vane or a vane portion). In most constructions, the root 202, the platform 204, and the airfoil 206 are formed as a single unitary component that is cast, forged, machined, additively manufactured, or made using any combination thereof or other suitable manufacturing techniques.

The root 202 is arranged to attach the turbine blade 200 to a rotor 122, a disk, or another component that supports the turbine blade 200 for rotation about the central axis 114. The root 202 can include lobes or hooks that engage corresponding lobes or hooks to attach the turbine blade 200 to the rotor 122. Of course, other arrangements of the root 202, beyond that illustrated in FIG. 2 are possible. Other arrangements could include a curved root 202 or could include fastening mechanisms in addition to the geometry of the root 202. Any arrangement and geometry of the root 202 could be employed as desired. As previously discussed, several turbine blades 200 are positioned adjacent one another to define a row of rotating blades 118.

The platform 204 is formed between the root 202 and the airfoil 206. The platform 204 includes a surface that cooperates with the same surface in other turbine blades 200 to define an inner annular flow path surface.

The airfoil 206 extends in a radial direction (i.e., radially with respect to the central axis 114) from the platform 204 to a tip portion 300. The airfoil 206 includes a leading edge 208, a trailing edge 210, a pressure-side surface 212, and a suction-side surface 214 that cooperate to define a vane perimeter 216.

Figure 3:
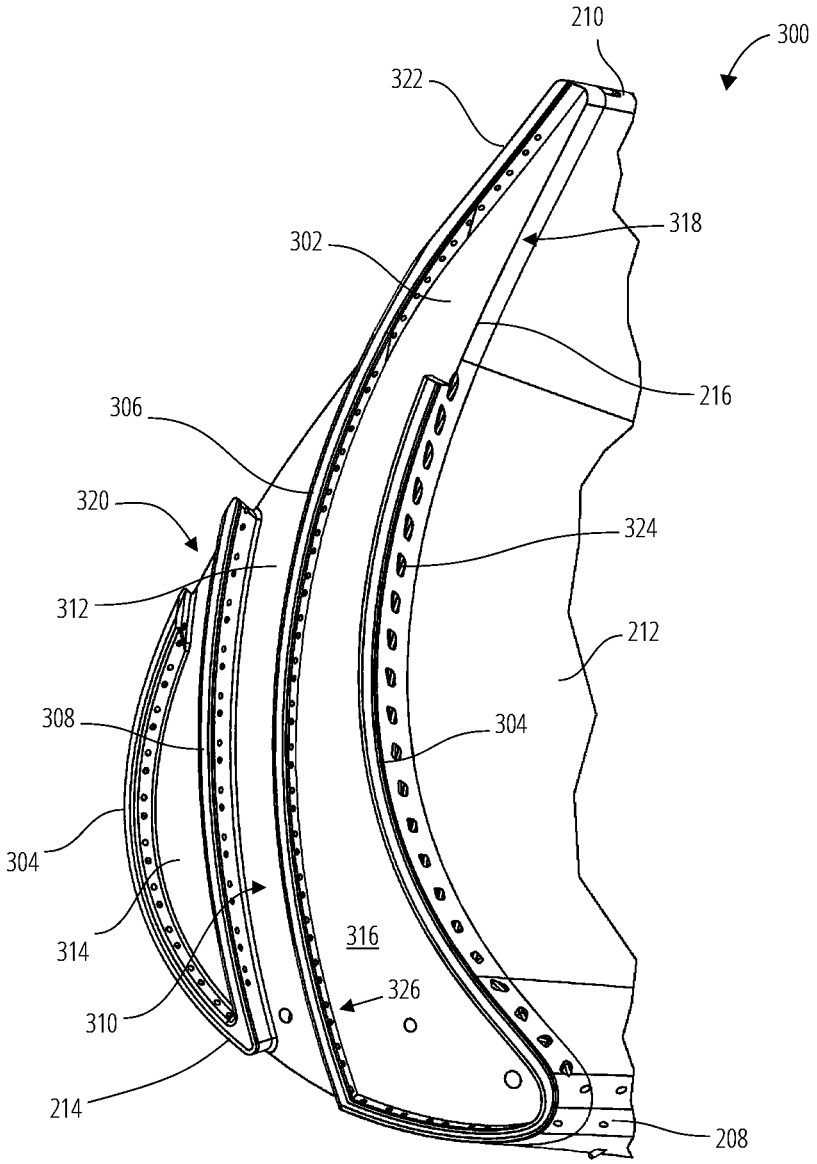
FIG. 3 illustrates a tip portion of the turbine blade of FIG. 2.

FIG. 3 better illustrates the tip portion 300 of the turbine blade 200 of FIG. 2. The tip portion 300 includes a tip surface 302 that is surrounded by the vane perimeter 216. A perimeter wall 304 extends along a portion of the vane perimeter 216 and extends above the tip surface 302. In the illustrated construction, the perimeter wall 304 is broken into two separate wall portions with other constructions including a single perimeter wall 304 that extends around a portion of the perimeter wall 304 or three or more wall portions that cooperate to define the perimeter wall 304. In the gas turbine art, the perimeter wall 304 is sometimes referred to as a squealer tip and is employed to at least partially define a tip seal between the airfoil 206 and a stationary surface adjacent the tip portion 300. The tip seal inhibits leakage across the airfoil 206 from the pressure-side surface 212 to the suction-side surface 214.

A first trench wall 306 extends from an upstream or leading edge 208 side of the suction-side surface 214 to a downstream or trailing edge 210 side of the suction-side surface 214. The first trench wall 306 extends radially from the tip surface 302 to a height that is preferably equal to the height of the perimeter wall 304 (e.g., between 2 mm and 15 mm). A second trench wall 308 extends from the upstream or leading edge 208 side of the suction-side surface 214 to the downstream or trailing edge 210 side of the suction-side surface 214. The second trench wall 308 extends radially from the tip surface 302 to a height that is preferably equal to the height of the perimeter wall 304 (e.g., between 2 mm and 15 mm). In the illustrated construction, the first trench wall 306 includes a perimeter portion 322 that defines a portion of the perimeter wall 304.

In the illustrated construction, the first trench wall 306 and the second trench wall 308 are parallel to one another, spaced apart from one another, and curved to define a trench 310 therebetween. The trench 310 includes a first open end that is near the leading edge 208 of the airfoil 206 and a second open end that is near the trailing edge 210 of the airfoil 206. In this context, the term "near" refers to the relative proximity of the described opening to the leading edge 208 or the trailing edge 210. Thus, "near the leading edge 208" would simply mean nearer to the leading edge 208 then to the trailing edge 210. In most constructions, the first trench wall 306 and the second trench wall 308 are between 5 mm and 20 mm from one another with other widths being possible. As will be discussed with regard to FIG. 5, the first trench wall 306 and the second trench wall 308 can have different shapes and different arrangements. For example, non-parallel trench walls could be employed. The trench 310 defines a trench bottom 312 that is substantially parallel to the tip surface 302 but that, as illustrated in FIG. 4 is depressed or located closer to the root 202 than the tip surface 302.

The perimeter wall 304 and the first trench wall 306 cooperate to define a pressure-side pocket 316 and a first wall gap 318. Similarly, the perimeter wall 304 and the second trench wall 308 cooperate to define a suction-side pocket 314 and a second wall gap 320. In addition, the perimeter wall 304, the first trench wall 306, and the second trench wall 308 define radially extending side surfaces. It should be noted that the radially extending surfaces could deviate slightly from a true radial direction, however, the surface extends predominantly in a radial direction.

A plurality of cooling holes 324 are formed in the various radially extending surfaces and provide an outlet for cooling air. Some cooling air is discharged by a portion of the plurality of cooling holes 324 into the suction-side pocket 314 and the pressure-side pocket 316. The first wall gap 318 and the second wall gap 320 provide an outlet for that cooling air. Thus, the perimeter wall 304 and the first trench wall 306 substantially surround the pressure-side pocket 316 and the perimeter wall 304 and the second trench wall 308 substantially surround the suction-side pocket 314. In this context, "substantially" means that the walls surround at least fifty percent of the respective suction-side pocket 314 and the pressure-side pocket 316. While some constructions could completely surround the suction-side pocket 314 and the pressure-side pocket 316, most constructions provide for the first wall gap 318 and the second wall gap 320. While "substantially surround" could mean as little as fifty percent, most constructions include walls that surround at least 70 percent and up to a 90 percent of the first wall gap 318 and the second wall gap 320.

Figure 4:
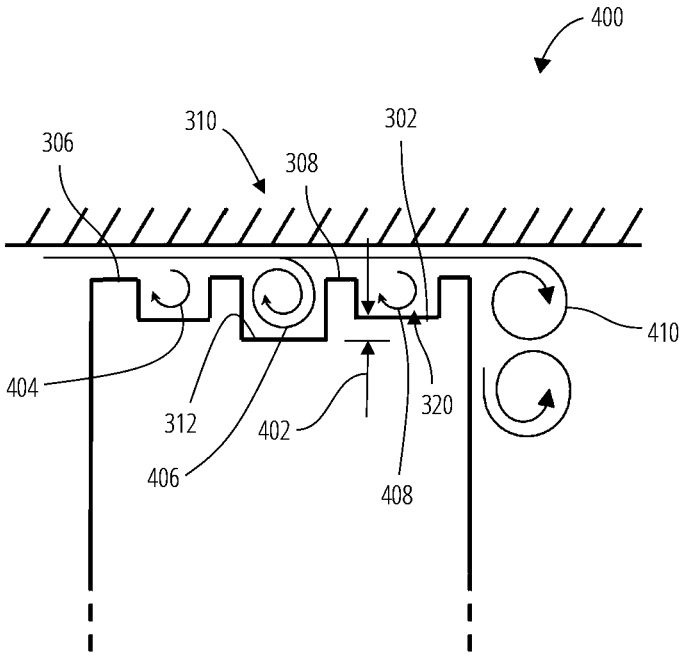
FIG. 4 is an outlet view of a trench of the tip portion of FIG. 3.

FIG. 4 better illustrates the increased depth 402 of the trench bottom 312 with respect to the tip surface 302. As illustrated, the increased depth 402 is between 2 mm and 15 mm with other ranges and differences being possible.

In addition, and with continued reference to FIG. 4 the tip portion 300 operates to produce a first space vortex 404, a trench vortex 406, a second space vortex 408, and a suction side tip-leakage vortex 410 each formed between the tip portion 300 and the stationary component adjacent the tip portion 300. The first space vortex 404 and the second space vortex 408 are formed in the pressure-side pocket 316 and the suction-side pocket 314 respectively and each produce pressure drops and flow efficiencies that reduce the total flow across the tip portion 300. The trench vortex 406 is formed in the trench 310 and also functions to produce a pressure drop that reduces the flow toward the suction side of the blade. Any flow that does pass over the tip portion 300 forms the suction side tip-leakage vortex 410, which has reduced size and intensity compared to conventional blade tip configurations. The width and the depth of the trench 310, the suction-side pocket 314, and the pressure-side pocket 316 can all be varied to control or adjust the size, depth and strength of the various vortices to achieve the desired leakage across the tip portion 300.

Figure 5:
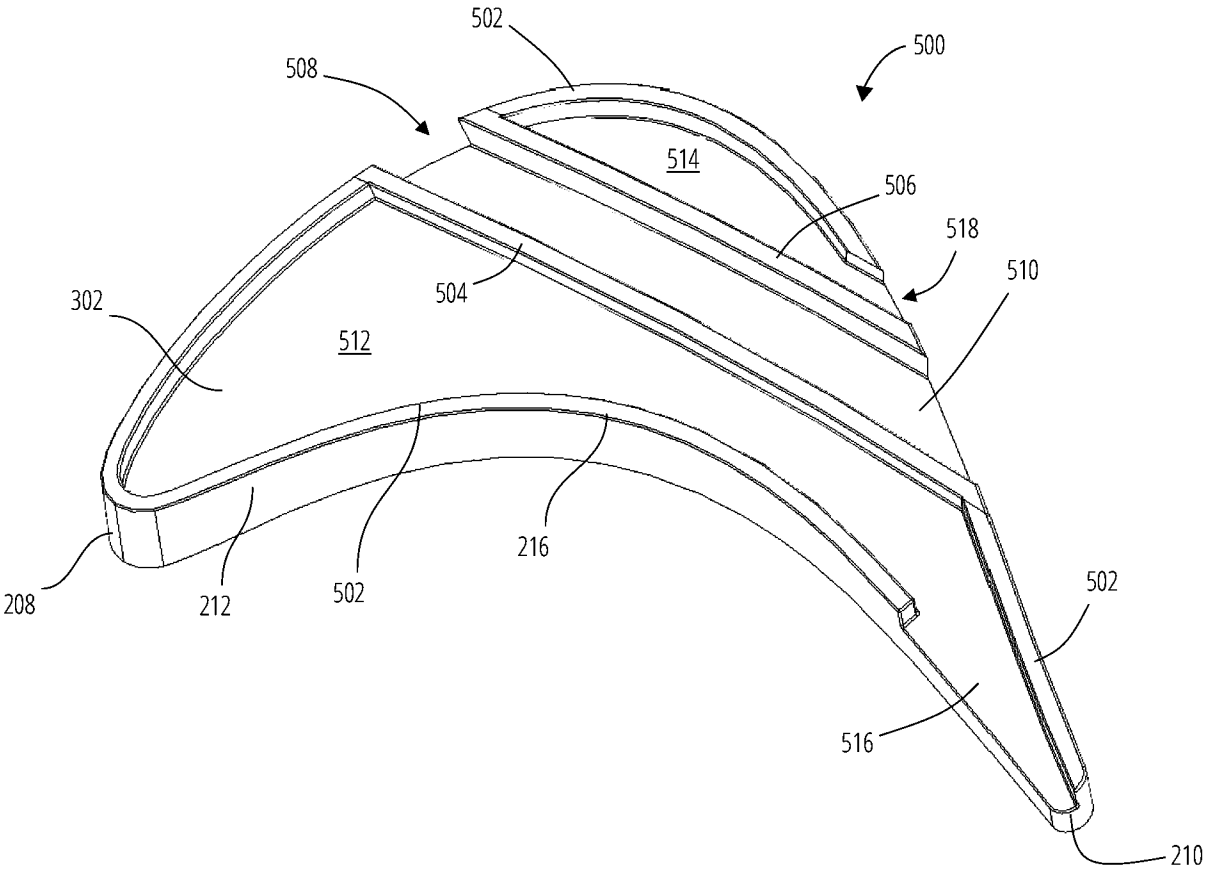
FIG. 5 illustrates another tip portion suitable for use with the turbine blade of FIG. 2.

FIG. 5 illustrates another construction of a tip portion 500 suitable for use with the turbine blade 200. Like the first construction of the tip portion 300, the tip portion 500 of FIG. 5 includes a perimeter wall 502 that extends around a portion of the vane perimeter 216. The perimeter wall 502 of FIG. 5 includes three separate portions rather than the two portions of FIG. 3. The perimeter wall 502 extends radially away from the tip surface 302 and defines substantially radially extending walls.

A first trench wall 504 extends from a leading edge 208 side of the suction-side surface 214 to a trailing edge 210 side of the suction-side surface 214. A second trench wall 506 extends from the leading edge 208 side of the suction-side surface 214 to the trailing edge 210 side of the suction-side surface 214 and cooperates with the first trench wall 504 to define a trench 508 having a trench bottom 510.

The perimeter wall 502 cooperates with the first trench wall 504 to at least partially surround and define a pressure-side pocket 512 and a first wall gap 516. Similarly, the perimeter wall 502 and the second trench wall 506 cooperate to define a suction-side pocket 514 and a second wall gap 518.

The tip portion 500 of FIG. 5 is substantially the same as the tip portion 300 of FIG. 3 with the exception of the first trench wall 504 and the second trench wall 506. Rather than curved, parallel trench walls, the first trench wall 504 and the second trench wall 506 are straight and parallel to one another. Like the trench 310 of FIG. 3, the trench 508 preferably has a width between 5 mm and 20 mm with other widths also being possible. As with the trench 310, the second trench 508 could employ non-parallel trench walls or walls of differing heights as desired.

Figure 6:
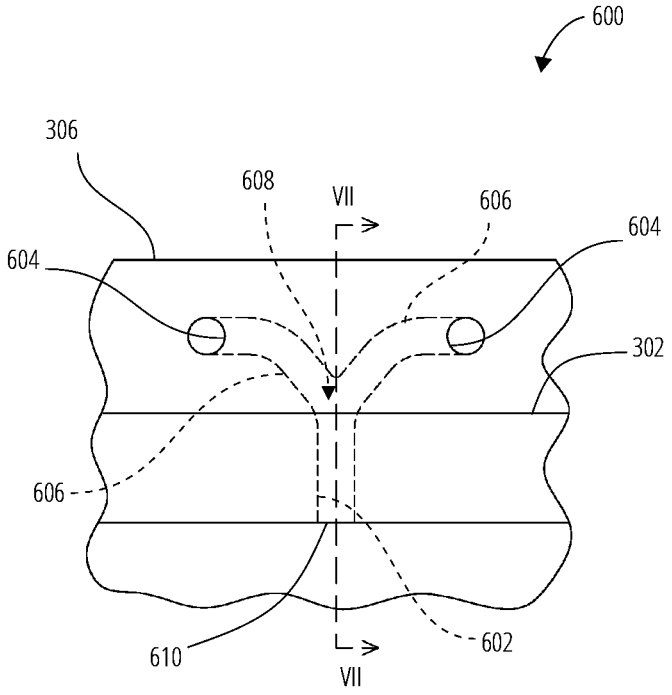
FIG. 6 illustrates a split cooling hole suitable for use in the blade tip of FIG. 3 or FIG. 5.

FIG. 6 illustrates one of the cooling holes 324 as including a split cooling hole 600 and looking in the viewing direction 326 shown in FIG. 3. As illustrated in FIG. 3, split cooling holes 600 are formed in at least a portion of the interior or radially extending walls of the perimeter wall 304, the first trench wall 306, and the second trench wall 308. Thus, a portion of the cooling holes 324, in the construction illustrated in FIG. 3 include some split cooling holes 600.

As illustrated in FIG. 6 each split cooling hole 600 includes a cooling hole inlet leg 602 and two cooling hole branches 606. The cooling hole inlet leg 602 extends from a cooling hole inlet 610 disposed on an inner surface of the tip surface 302 to a cooling hole branch point 608 located in the first trench wall 306, the perimeter wall 304, or the second trench wall 308. At the cooling hole branch point 608, the cooling hole inlet leg 602 branches into two cooling hole branches 606 with each of the cooling hole branches 606 including a separate and distinct cooling hole outlet 604. While the illustrated construction illustrates a split cooling hole 600 with two cooling hole branch 606, other constructions may include three or more cooling hole branches 606.

The split cooling holes 600 can be formed using a drilling or boring operation or could be formed using an additive manufacturing process during the formation of the turbine blade 200 or the tip portion 300, 500 of the turbine blade 200.

Figure 7:
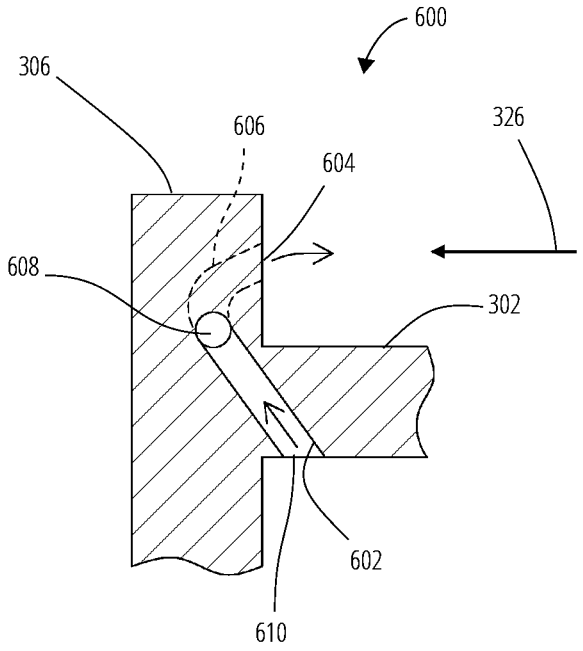
FIG. 7 is a section view taken along line VII-VII of FIG. 6 illustrating the interior arrangement of the split cooling hole.

FIG. 7 is a section view taken along line VII-VII of FIG. 6 that better illustrates other features of the split cooling hole 600. As can be seen, the cooling hole inlet leg 602 is angled obliquely with respect to the tip surface 302 and the first trench wall 306. In preferred constructions, the cooling hole inlet leg 602, the cooling hole branch point 608, and the cooling hole branches 606 include smooth aerodynamic transitions (curves rather than sharp corners) to assure smooth and efficient cooling air flow therethrough.

While the illustrated construction of the split cooling hole 600 includes substantially symmetric (about the section line VII-VII) cooling hole branches 606, other constructions may include asymmetric cooling hole branches 606 such that the cooling hole outlet 604 of each cooling hole branch 606 can be directed to different angles and serve to cool different areas in the first trench wall 306, second trench wall 308, or perimeter wall 304 from which they exit while still consuming the same cooling mass flow as one straight through hole.

Additionally, the positioning of the cooling hole outlets 604 in the perimeter wall 304, first trench wall 306, and second trench wall 308 makes it possible to directly cool these features (often referred to as a squealer tip). In particular, the illustrated arrangement allows for direct cooling of the inner surfaces (surfaces inside the perimeter of the airfoil 206) which increases the cooling effectiveness at the perimeter wall 304, first trench wall 306, and second trench wall 308 which are directly cooled by heat conduction through the split cooling holes 600.

During operation of the gas turbine engine 100, high-pressure, high-temperature exhaust gas 128 flows between adjacent turbine blades 200 where it is expanded to extract energy in the form of rotational work. Due to the high temperature of the exhaust gas 128, it is difficult to form a seal between the tip surface 302 of the turbine blade 200 and the stationary component adjacent the turbine blade 200. The addition of the tip portion 300 or the tip portion 500 enhances the seal during operation. Specifically, exhaust gas 128 tends to leak across the tip surface 302 from the pressure-side surface 212 to the suction-side surface 214. The addition of the perimeter wall 304 or the perimeter wall 502 enhances the seal. However, the further addition of the trench 310 or the trench 508 creates the pressure-side pocket 316 or the pressure-side pocket 512 and the suction-side pocket 314 or the suction-side pocket 514 which create flow conditions at the tip portion 300 or the tip portion 500 of the turbine blade 200 that makes flow from the pressure-side surface 212 to the suction-side surface 214 more difficult, thereby enhancing the sealing efficiency.

The arrangement of the perimeter wall 304, the first trench wall 306, and the second trench wall 308 of the tip portion 300 as well as the perimeter wall 502, the first trench wall 504, and second trench wall 506 of the tip portion 500 are provided with direct cooling air to reduce their operating temperatures and reduce the likelihood of damage, such as oxidation during operation. Cooling air extracted from the compressor section 102 passes through the turbine blades 200, the split cooling holes 600, and the plurality of cooling holes 324 to directly cool the various walls as required.

In addition, during certain operating conditions it is possible that cooling air can become trapped in the suction-side pocket 314, 514 or the pressure-side pocket 316, 512. The first wall gap 318 and the second wall gap 320 as well as the first wall gap 516 and the second wall gap 518 provide an outlet for that trapped cooling air to allow for its efficient escape.

Although an exemplary embodiment of the present disclosure has been described in detail, those skilled in the art will understand that various changes, substitutions, variations, and improvements disclosed herein may be made without departing from the spirit and scope of the disclosure in its broadest form.

None of the description in the present application should be read as implying that any particular element, step, act, or function is an essential element, which must be included in the claim scope: the scope of patented subject matter is defined only by the allowed claims. Moreover, none of these claims are intended to invoke a means plus function claim construction unless the exact words "means for" are followed by a participle.

What is claimed is:

1. A turbine blade comprising:

a root arranged to attach the turbine blade to a rotor;

a vane extending in a radial direction from the root to a tip surface, the vane including a leading edge, a trailing edge, a pressure-side surface, and a suction-side surface that cooperate to define a vane perimeter;

a perimeter wall extending radially from the tip surface and surrounding a portion of the vane perimeter;

a first trench wall extending across the tip surface and cooperating with the perimeter wall to substantially enclose a pressure-side pocket; and a second trench wall extending across the tip surface and cooperating with the perimeter wall to substantially enclose a suction-side pocket, wherein the first trench wall and the second trench wall cooperate to define a trench having a trench bottom, the trench extending from a first portion of the suction-side surface near the leading edge to a second portion of the suction-side surface near the trailing edge.

2. The turbine blade of claim 1, wherein a radial distance from the trench bottom to the root is less than a radial distance from the tip surface to the root.

3. The turbine blade of claim 1, wherein the first trench wall and the second trench wall are parallel to one another and spaced apart from one another by at least 5 mm.

4. The turbine blade of claim 1, further comprising a plurality of cooling holes, each cooling hole of the plurality of cooling holes formed through a radially extending surface of one of the first trench wall, the second trench wall, and the perimeter wall.

5. The turbine blade of claim 1, wherein the first trench wall is a curved wall having a perimeter portion that defines a portion of the perimeter wall.

6. The turbine blade of claim 1, wherein one of the perimeter wall, the first trench wall, and the second trench wall at least partially defines at least one split cooling hole.

7. The turbine blade of claim 1, wherein the perimeter wall includes a first wall gap and a second wall gap.

8. The turbine blade of claim 7, wherein the first wall gap provides an opening between the pressure-side pocket and the pressure-side surface.

9. The turbine blade of claim 7, wherein the second wall gap provides an opening between the suction-side pocket and the suction-side surface.

10. A turbine blade comprising:

a root arranged to attach the turbine blade to a rotor;

a platform coupled to the root;

a vane extending in a radial direction from the platform to a tip surface, the vane including a leading edge, a trailing edge, a pressure-side surface, and a suction-side surface that cooperate to define a vane perimeter;

a perimeter wall extending radially from the tip surface and surrounding a portion of the vane perimeter;

a trench extending from a first portion of the suction-side surface near the leading edge to a second portion of the suction-side surface near the trailing edge, the trench including a first trench wall, a second trench wall, and a trench bottom;

a pressure-side pocket defined by the first trench wall and a portion of the perimeter wall; and a suction-side pocket defined by the second trench wall and a portion of the perimeter wall.

11. The turbine blade of claim 10, wherein the perimeter wall includes a first wall gap and a second wall gap.

12. The turbine blade of claim 11, wherein the first wall gap provides an opening between the pressure-side pocket and the pressure-side surface.

13. The turbine blade of claim 11, wherein the second wall gap provides an opening between the suction-side pocket and the suction-side surface.

14. The turbine blade of claim 10, wherein a radial distance from the trench bottom to the root is less than a radial distance from the tip surface to the root.

15. The turbine blade of claim 10, wherein the first trench wall and the second trench wall are each curved, parallel to one another, and spaced apart from one another by at least 5 mm.

16. The turbine blade of claim 10, further comprising a plurality of cooling holes, each cooling hole of the plurality of cooling holes formed through a radially extending surface of one of the first trench wall, the second trench wall, and the perimeter wall.

17. The turbine blade of claim 16, wherein at least one cooling hole is a split cooling hole including a single cooling hole inlet leg and two cooling hole branches, each cooling hole branch extending from the cooling hole inlet leg to a separate and distinct cooling hole outlet.

18. A turbine blade comprising:

a root arranged to attach the turbine blade to a rotor;

a platform coupled to the root;

a vane extending in a radial direction from the platform to a tip surface, the vane including a leading edge, a trailing edge, a pressure-side surface, and a suction-side surface that cooperate to define a vane perimeter;

a curved trench extending from a first portion of the suction-side surface near the leading edge to a second portion of the suction-side surface near the trailing edge, the trench including a trench bottom, a radial distance from the trench bottom to the platform being less than a radial distance from the tip surface to the platform;

a pressure-side pocket defined by a pressure-side wall, a leading-edge wall, a first suction-side wall, a first trench wall, and a second suction-side wall that each extend radially away from the tip surface; and a suction-side pocket defined by a third suction-side wall and a second trench wall that each extend radially away from the tip surface.

19. The turbine blade of claim 18, wherein the pressure-side wall and the second suction-side wall cooperate to define a first wall gap, and wherein the first wall gap provides an opening between the pressure-side pocket and the pressure-side surface.

20. The turbine blade of claim 19, wherein the third suction-side wall and the second trench wall cooperate to define a second wall gap, and wherein the second wall gap provides an opening between the suction-side pocket and the suction-side surface.

21. The turbine blade of claim 18, wherein the first trench wall and the second trench wall are parallel to one another and spaced apart from one another by at least 5 mm.

* * * * *